United States Patent [19]

Disser et al.

[11] Patent Number: 4,931,707

[45] Date of Patent: Jun. 5, 1990

[54] IMPEDANCE MATCHING CIRCUIT

[75] Inventors: Robert J. Disser, Dayton; Richard N. Lehnhoff, Kettering, both of Ohio

[73] Assignee: General Motors Corporation, Detroit, Mich.

[21] Appl. No.: 393,358

[22] Filed: Aug. 14, 1989

[51] Int. Cl.[5] ..... G05F 1/10

[52] U.S. Cl. ..... 318/293; 307/98; 307/257; 307/104

[58] Field of Search ..... 318/293; 361/77, 82; 333/17.3; 307/89, 90, 98, 99, 104, 112, 257, 296.4, 592

[56] References Cited

U.S. PATENT DOCUMENTS 4,276,484 6/1981 Riveros ..... 307/104

FOREIGN PATENT DOCUMENTS 54-144922 11/1979 Japan ..... 307/104

55-00677 1/1980 Japan ..... 307/98

*Primary Examiner*—Ro Bentsuro

*Attorney, Agent, or Firm*—Mark A. Navarre

[57] ABSTRACT

The disclosure describes an impedance matching circuit for maintaining the input impedance, of a drive transistor as sensed by a driver circuit, substantially constant. The circuit is connected to the input of the drive transistor such that when the drive transistor is forward biased, the input impedance sensed by the drive circuit is the input impedance of the drive transistor, and when the drive transistor is reverse biased, the input impedance sensed by the driver circuit is the combination of the input impedance of the drive transistor and an impedance of the matching circuit.

5 Claims, 1 Drawing Sheet

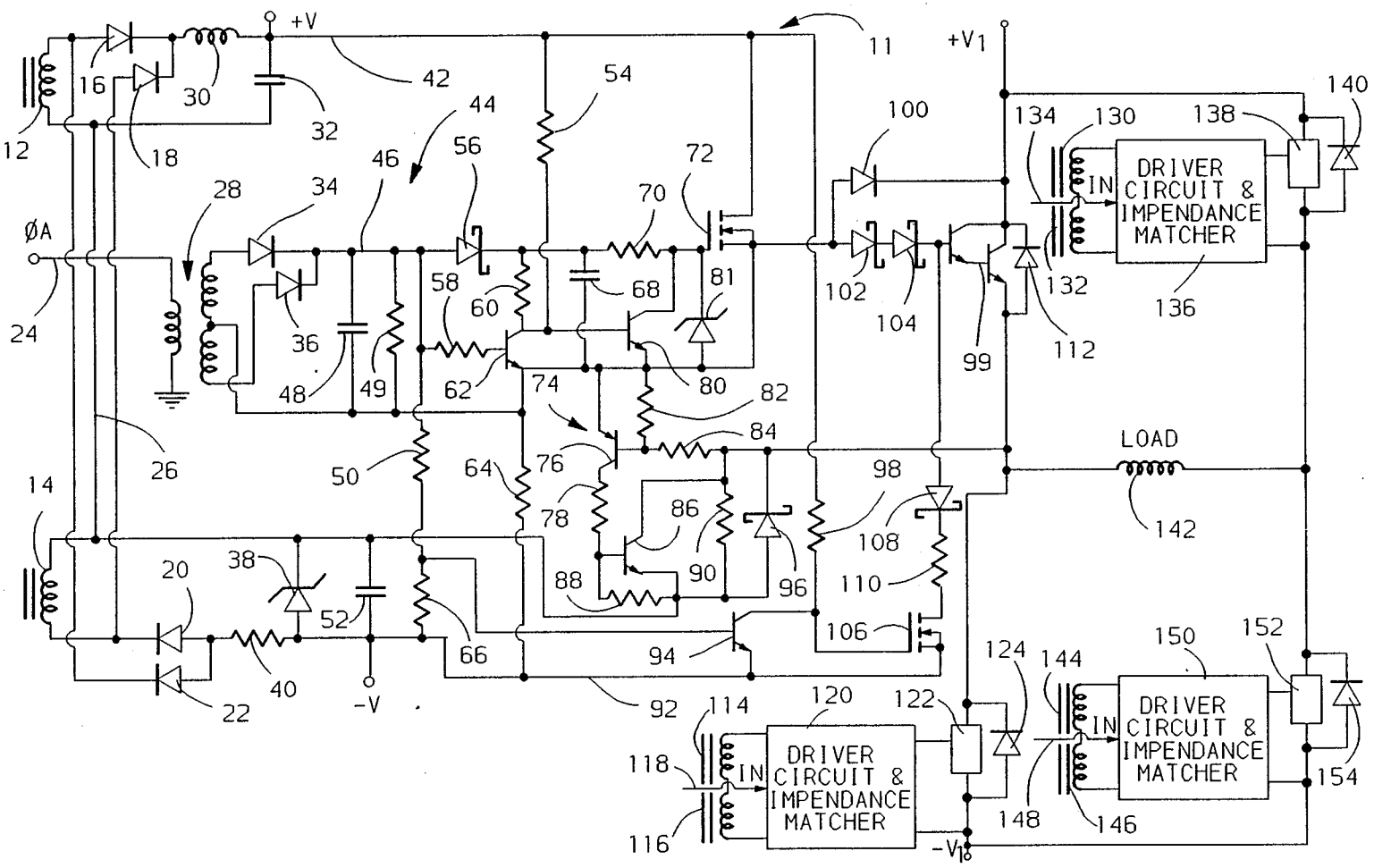
DRIVER CIRCUIT & IMPENDANCE MATCHER
DRIVER CIRCUIT & IMPENDANCE MATCHER
DRIVER CIRCUIT & IMPENDANCE MATCHER
IN
IN
IN
LOAD
+V1
-V1
+V
-V
ØA

IMPEDANCE MATCHING CIRCUIT

An impedance matching circuit for maintaining the input impedance of a drive transistor, as sensed by a driver circuit, substantially constant.

BACKGROUND OF THE INVENTION

Inductive loads are often operated in a manner such that the currents through the loads are rapidly switched. This is the case for the coils in three phase motors. The switching of the current for these inductive loads may be controlled by switching drive transistors, such as power transistors, connected in bridge networks. When the transistors in a bridge network are switched so that the voltage applied to the inductive load is different from the voltage previously applied, there will be a current lag through the inductor. This means that although the voltage across the inductor has changed, the inductance causes the current to lag or remain the same as it was previously for a short period of time. During the time that the current is lagging the voltage, the drive transistors in the bridge network that have just turned on may become reverse biased. When the driver circuit signals the drive transistor to turn on, the drive transistor will thus first be reverse biased by the lagging current in the load, and then be forward biased after the current achieves the same polarity as the voltage. This is undesirable because the input impedance of the drive transistor when it is reverse biased is different from the input impedance when it is forward biased. This changing impedance may adversely affect the current regulator for the driver circuit.

SUMMARY OF THE PRESENT INVENTION

The present invention is directed to an improved impedance matching circuit which maintains a substantially constant input impedance of the drive transistors, as sensed by the driver circuit. The present invention can be used for a wide variety of drive transistors, in a wide variety of control and bridge circuits. The matching circuit of the invention connects to the input of the drive transistor in a manner such that, when the driver circuit signals the drive transistors to turn on, the input impedance of the drive transistor as sensed by the driver circuit is the combination of the input impedance of the drive transistor and the impedance of the matching circuit. When the driver circuit signals the drive transistor to turn off, the matching circuit does not have an active function.

The impedance matching circuit has two main elements, a variable impedance element and a control element. The variable impedance element in turn has two partial elements, an impedance element and a shunt element. During the forward bias of the drive transistor, the control element signals the shunt element to shunt the impedance element so that the impedance of the matching circuit is minimal. When this happens, the input impedance sensed by the driver circuit is the input impedance of the drive transistor. During the reverse bias of the drive transistor, the control element signals the shunt element to engage the impedance element. When this happens, the combination of the impedances of the drive transistor and the matching circuit is equal to the impedance of the drive transistor when the drive transistor is forward biased. In this manner, the circuit of the invention operates to maintain a substantially constant input impedance as sensed by the driver circuit.

BRIEF DESCRIPTION OF THE DRAWING

The single drawing figure shows one implementation of the invention. The drawing shows the matching circuit of the invention connected to a driver circuit and a power transistor. It shows three other similar circuits generally as boxes connected to three other power transistors. The power transistors are connected in an H-bridge to an inductive load.

DETAILED DESCRIPTION OF THE DRAWING

The single drawing figure shows the invention implemented in a driver circuit used to control one drive transistor, here power transistor 99, of an H-bridge. The figure also shows how three other similar circuits 120, 136 and 150, connected to power transistors 122, 138 and 152, with respective free wheeling diodes 124, 140 and 154, controlled by lines 118, 134 and 148, would be connected to the rest of the H-bridge.

Power is supplied to the driver and impedance matching circuit 11 from a single transformer primary through the secondaries 12 and 14. The primary winding of the transformer (not shown) receives power from an AC power source through a current regulator (also not shown, but explained in detail in copending U.S. patent application, Ser. No. 338,821, filed Apr. 17, 1989, and assigned to the assignee of the present invention). The power is converted to a DC voltage through diodes 16, 18, 20 and 22, inductor 30, capacitors 32 and 52 and Zener diode 38. The secondary windings 12 and 14 are driven by the same primary as the secondary windings 114 and 116, which supply the power to the driver circuit and impedance matcher 120. Likewise, secondaries 130, 132, 144 and 146 are all driven by a single transformer primary (not shown).

In the operation of the bridge circuit, only two of the power transistors are biased conductive at the same time. Either transistor 99 is biased conductive together with transistor 152, or transistor 122 is biased conductive together with transistor 138. Transistors 99 and 122 are alternately on and off, similarly transistors 138 and 152 are alternately on and off. Since transistors 99 and 122 are alternately on and off, only one of them is drawing forward bias current from their respective driver circuits at a time. Hence, at any point in time, ideally one of their two driver circuits is drawing, from the transformer, the power required to forward bias a power transistor. In this ideal mode of operation, the current draw from each primary remains substantially constant.

The driver and impedance matching circuit 11 is controlled by a signal on line 24. The modulated control signal goes through transformer 28 and is demodulated by the circuit indicated generally as 44, comprising the diodes 34 and 36 and the capacitor 48. The rest of the driver circuit, comprising diode 100, schottky diodes 56, 102, 104 and 108, Zener diode 81, resistors 49, 50, 54, 58, 60, 64, 66, 70, 98 and 110, capacitor 68, transistors 62, 80 and 94 and FET's 72 and 106, controls the on-off state of the power transistor 99, biasing the transistor 99 conductive in the on state and nonconductive in the off state. This circuit is explained in detail in the above copending U.S. patent application, Ser. No. 338,821. The circuit is used in that application as part of a control circuit for a transistor bridge inverter for multiple phase AC machines.

The circuit, indicated generally by the number 74, is the impedance matching circuit. Under certain operating conditions of the bridge, the lagging power factor of the load 142 can cause the power transistor 99 to be reverse biased even though it is signaled by the driver circuit to a conductive state. This occurs when the winding voltage in the load 142 is positive and the lagging power factor causes the winding current to be negative. Although the power transistor 99 is trying to apply voltage to the phase winding, the winding current is being carried by the transistor's freewheeling diode 112. This causes the transistor 99 to be reverse biased with a voltage drop across the base-emitter junction at one diode drop (approximately one volt) negative. The voltage across the base-emitter junction of a forward biased transistor is two diode drops (approximately two volts) positive.

The above condition causes the load impedance on the transformer secondary windings 12 and 14 to be significantly lower when the transistor 99 is reverse biased than when it is forward biased. Normally, this would cause the current regulator of the primary transformer which supplies power to secondaries 12 and 14 to reduce the primary voltage in order to maintain the desired primary winding current. This in turn would lead to insufficient drive capability in the turn-on of transistor 122 and consequent conduction losses therein.

The reverse bias impedance change described above is remedied, according to this invention, by the impedance matching circuit 74. The resistor 90 is connected between the emitter of the power transistor 99 and the common line 26 of the power supply. The resistor 90 is shunted by transistor 86 with the associated bias resistors 78 and 88. Together resistor 90 and transistor 86 form a variable impedance element having a low impedance when transistor 86 is biased conductive and having a high impedance when transistor 86 is biased nonconductive. Transistor 86 is controlled by transistor 76 with the associated base resistors 82 and 84, and protected from reverse bias saturation by schottky diode 96. Thus, the emitter of transistor 76 is connected to the base of the power transistor 99 through schottky diodes 102 and 104, and the base of transistor 76 is connected to the emitter of the power transistor 99 through resistor 84.

If the bridge transistor 99 is forward biased when signal line 46 is high (the normal situation), transistors 76 and 86 conduct due to the positive two diode voltage drop across the base-emitter junction of transistor 99. When transistor 86 is conducting, it shunts resistor 90. In this condition, the voltage drop across the series combination of the base-emitter circuit of bridge transistor 99 and the impedance matching network 74 is approximately two (2) volts.

If the bridge transistor 99 is reverse biased when signal line 46 is high (the power factor induced situation), the transistor 76 is held off by the negative one diode voltage drop across the base-emitter junction of transistor 99. Transistor 86 is also biased off, engaging the resistor 90 in series with the emitter of transistor 99. In this condition, the voltage drop across the series combination of the base-emitter circuit of bridge transistor 99 and the impedance matching network 74 is determined by the sum of the negative one (1) volt across the base-emitter junction of transistor 99 and the positive voltage across resistor 90. The resistor 90 is sized in relation to the base drive current so that the resistor voltage in such condition is approximately three (3) volts. In such case, the voltage drop across the series combination of the base-emitter circuit of the power transistor 99 and the impedance matching network 74 during reverse bias operation is two (2) volts, just as in the forward bias condition. For example, if the base drive current is regulated to 1.5 A, the value of resistor 90 is 2 ohms. In this way, the impedance matching circuit of this invention causes the input impedance sensed by the driver circuit to remain substantially constant during the on-times of transistor 99, thereby enabling better regulation of the base drive current.

While described in reference to the illustrated embodiment, the matching circuit of this invention does not need to appear as in the above circuit, and can be applied in a wide variety of circuits used to drive reactive loads. Moreover various other modifications will occur to those skilled in the art, and incorporation of those modifications may fall within the scope of this invention which is defined in the claims below.

The embodiments of the invention in which an exclusive property or privilege is claimed are defined as follows:

1. In a driver circuit which is sensitive to the input impedance of a device to which it is connected, the driver circuit connected to a drive transistor that provides power for an inductive load, the drive transistor having on times during which it is normally forward biased but may be reverse biased due to load inductance, the drive transistor also having an input circuit having a low input circuit impedance when reverse biased and a high input circuit impedance when forward biased, the improvement comprising:

variable impedance means connected in series with the drive transistor input circuit so that the input impedance sensed by the driver circuit is the combined impedance of the drive transistor and the variable impedance means, the impedance means comprising an impedance element and a shunt element, the impedance element having a value such that, when the drive transistor is reverse biased, the combined impedance of the drive transistor input circuit and the impedance element is equal to the impedance of the drive transistor input circuit when the drive transistor is forward biased, the shunt element operating to selectively shunt the impedance element; and a control means for signaling the shunt means to connect the impedance element when the drive transistor is reverse biased, and signaling the shunt element to shunt the impedance element when the drive transistor is forward biased, whereby the input impedance sensed by the driver circuit remains substantially constant during on times of the drive transistor.

2. The circuit set forth in claim 1, wherein the impedance element includes a resistor.

3. The circuit set forth in claim 1, wherein the shunt element includes a transistor which, when biased nonconductive, connects the impedance element and, when biased conductive, shunts the impedance element.

4. The circuit set forth in claim 1 wherein the control means includes a transistor which is biased conductive in response to the drive transistor being forward biased and which is biased nonconductive in response to the drive transistor being reverse biased.

5. In a driver circuit which is sensitive to the input impedance of a device to which it is connected, the driver circuit connected to a drive transistor that provides power for an inductive load, the drive transistor having on times during which it is normally forward biased but may be reverse biased due to load inductance, the drive transistor also having an input circuit having a circuit impedance when reverse biased and a high input circuit impedance when forward biased, the improvement comprising:

variable impedance means connected in series with the drive transistor input circuit so that the input impedance sensed by the driver circuit is the combined impedance of the drive transistor and the variable impedance means, the impedance means comprising the parallel combination of a resistor and a first transistor, the resistor having a value such that, when the drive transistor is reverse biased, the combined impedance of the drive transistor input circuit and the resistor is equal to the impedance of the drive transistor input circuit when the drive transistor is forward biased, the first transistor operating such that, when biased nonconductive, it connects the resistor and, when biased conductive, it shunts the resistor; and a second transistor connected to both the drive transistor and the first transistor such that when the drive transistor is forward biased, the second transistor biases the first transistor conductive, and when the drive transistor is reverse biased, the second transistor biases the first transistor nonconductive, whereby the input impedance sensed by the driver circuit remains substantially constant during on times of the drive transistor.

* * * * *